United States Patent [19]

Salmi

[11] 4,039,033

[45] Aug. 2, 1977

[54] HYDRAULIC ROCK DRILL

[75] Inventor: Pekka M. Salmi, Tampere, Finland

[73] Assignee: Oy Tampella AB, Tampere, Finland

[21] Appl. No.: 649,679

[22] Filed: Jan. 16, 1976

[30] Foreign Application Priority Data

Jan. 16, 1975 Finland ..... 750097

[51] Int. Cl.[2] ..... B25D 9/00

[52] U.S. Cl. ..... 173/105; 173/DIG. 4

[58] Field of Search ..... 173/DIG. 4, 107, 105; 91/300

[56] References Cited

U.S. PATENT DOCUMENTS

| | | | |
|---|---|---|---|
| 1,074,116 | 9/1913 | Haeseler | 173/107 |
| 1,080,880 | 12/1913 | Bayles | 173/107 |
| 2,457,969 | 1/1949 | Anderson | 173/107 |
| 3,406,763 | 10/1968 | Worman | 173/107 X |
| 3,739,863 | 6/1973 | Wohlwend | 173/DIG. 4 |
| 3,866,690 | 2/1975 | Lance et al. | 173/DIG. 4 |
| 3,896,889 | 7/1975 | Bouyoucos | 173/DIG. 4 |
| 3,903,972 | 9/1975 | Bouyoucos et al. | 173/DIG. 4 |
| 3,965,799 | 6/1976 | Juvonen et al. | 91/300 X |

*Primary Examiner*—Lawrence J. Staab

*Attorney, Agent, or Firm*—Roylance, Abrams, Berdo & Kaul

[57] ABSTRACT

An hydraulically operated striking apparatus for driving a rock drill comprises a body having an axial, cylindrical, interior space with an inwardly protruding annular member. A cylindrical piston is positioned in the space in sliding contact with the protruding annular member, and the piston has a canal in its outer surface. The body, the annular member and the piston define two annular spaces and an annular distributing valve is caused to slide within one of the spaces under fluid pressure. The two spaces communicate with each other by means of the piston canal when the piston is in a first slidable position, and the protruding annular member prevents communication between the two spaces when the piston is in a second slidable position. The piston is provided with an axially disposed extension which, in combination with an outlet, serves to permit a third annular axial space to communicate with either an inlet or an outlet at all times. After the fluid under pressure has moved the distributing valve, it is conducted to a rotating hydraulic motor and drives the motor to rotate the apparatus.

2 Claims, 3 Drawing Figures

HYDRAULIC ROCK DRILL

This invention relates to an hydraulically operated striking apparatus. More particularly, this invention relates to a striking apparatus operated by pressure liquid, preferably for a rock drill, the said striking apparatus comprising a body to which the tool can be movably attached, a striking piston moving to and fro in the cylinder space and a liner type distributing valve concentric with the piston, moving to and fro in the valve space and aimed for changing the direction of the motion of the piston. Pressure liquid from an annular space defined by the body of the drill, the piston and the distributing valve, which has been used to operate the valve is employed to operate an hydraulic rotating motor.

Various rock drills have been suggested which are operated by pressure liquid. One such rock drill is described in copending U.S. Pat. application Ser. No. 569,531, filed Apr. 18, 1975, in the name of P. Salmi and P. Raunio, which rock drill comprises a body to which a tool can be attached, a striking piston moving to and fro in a cylinder space, a distributing valve located in a distributing valve space and an hydraulic motor rotating the tool. The piston and the distributing valve are operated by pressure liquid. The object of the distributing valve is to accomplish the motion of the piston to and fro.

There are various other ways to arrange the mutual operation and placement of the piston and the distributing valve as can be seen, for example, from U.S. Pat. No. 3,322,210, and French Pat. No. 1,431,835. Characteristic of such arrangements is that the pressure liquid causes the distributing valve to move from one position to another, whereafter the pressure liquid flows into an outlet canal. The pressure liquid needed by the rotating motor is conveyed through a separate canal from a pressure liquid source which serves both the striking apparatus and the rotating motor which rotaes the tool. From the rotating motor the liquid flows into the outlet canal.

The known arrangement described above have various disadvantages because the pressure liquid escaping from the distributing valve space does not accomplish any further useful work. Thus, the economy of the pressure liquid is poor.

The objects of this invention include the elimination of the foresaid disadvantages and to provide a striking apparatus, wherein the total consumption of liquid decreases because the pressure liquid can be better utilized in the machine, the tube for conveying liquid from an outside pump to the rotating motor can be eliminated, and overloading of the machine due to too strong resistance to rotate is eliminated.

These and other objects are achieved with the present invention, which comprises, in a striking apparatus of the type having body means having an interior space, striking piston means axially slidable between first and second positions within said interior space, said piston means and said body means defining an annular valve space, distributing valve means slidably disposed in said anular valve space and being axially slidable between first and second positions, and means for supplying fluid under pressure to operate said piston means and said valve means, the improvement comprising means in said body means defining a body outlet means for conducting fluid under pressure from said body means after said fluid has actuated said distributing valve means, an hydraulic rotating motor, and means for conveying said fluid under pressure from said body outlet means to said hydraulic rotating motor to rotate said motor.

Thus, the present invention eliminates prior disadvantages by leading the hydraulic oil, which moved the distributing valve, to the rotating motor of the rock drill for operating this and thus accomplishing useful work. An apparatus according to the invention is possible because it has been proved that the pressure and amount of the escaping liquid are appropriate to rotate the rotating motor under normal drilling circumstances. If the resistance of the drill to rotate increases, for example, in a broken rock, also the pressure of the oil in the outlet canal increases. When the resistance to rotate reaches a certain point, the pressure of the oil in the outlet canal has grown so high that the distributing valve can no longer move. Thereby also the movement of the piston stops. Thus, a too high resistance to rotate is prevented from overloading the machine.

In order that the manner in which the foregoing and other objects are attained in accordance with the present invention can be understood in detail, a particularly advantageous embodiment thereof will be described with reference to the accompanying drawings, which form a part of this specification, and wherein.

In this application, the terms "down", "under" and "lower" mean that end of the apparatus to which the tool is attached and "up", "above" and "upper", the opposite end of the apparatus.

Figure 1:
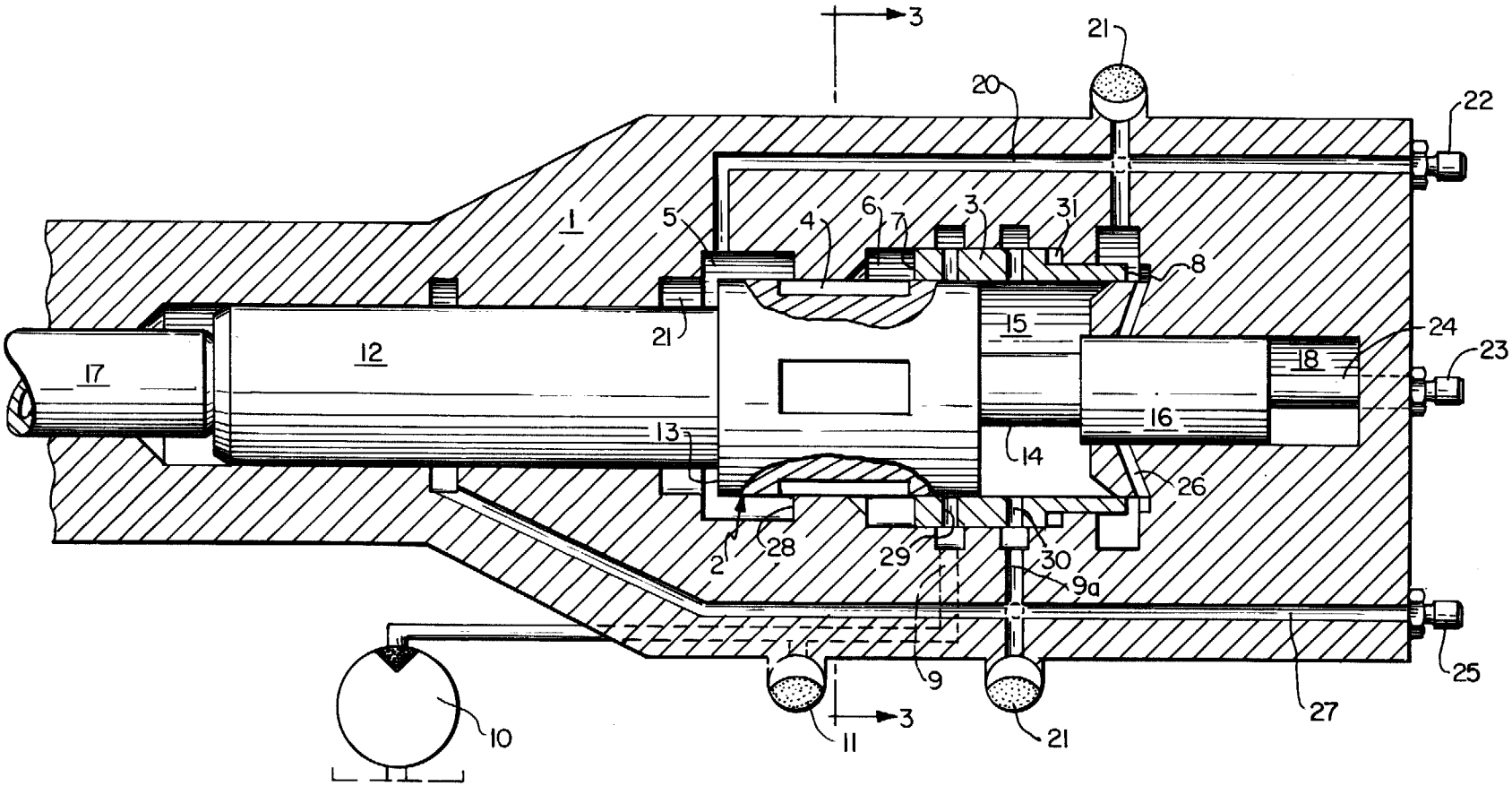
FIG. 1 is a side elevational view of the striking apparatus of the present invention partly in section, showing the piston in its lowest position at the end of a work stroke.
Figure 2:
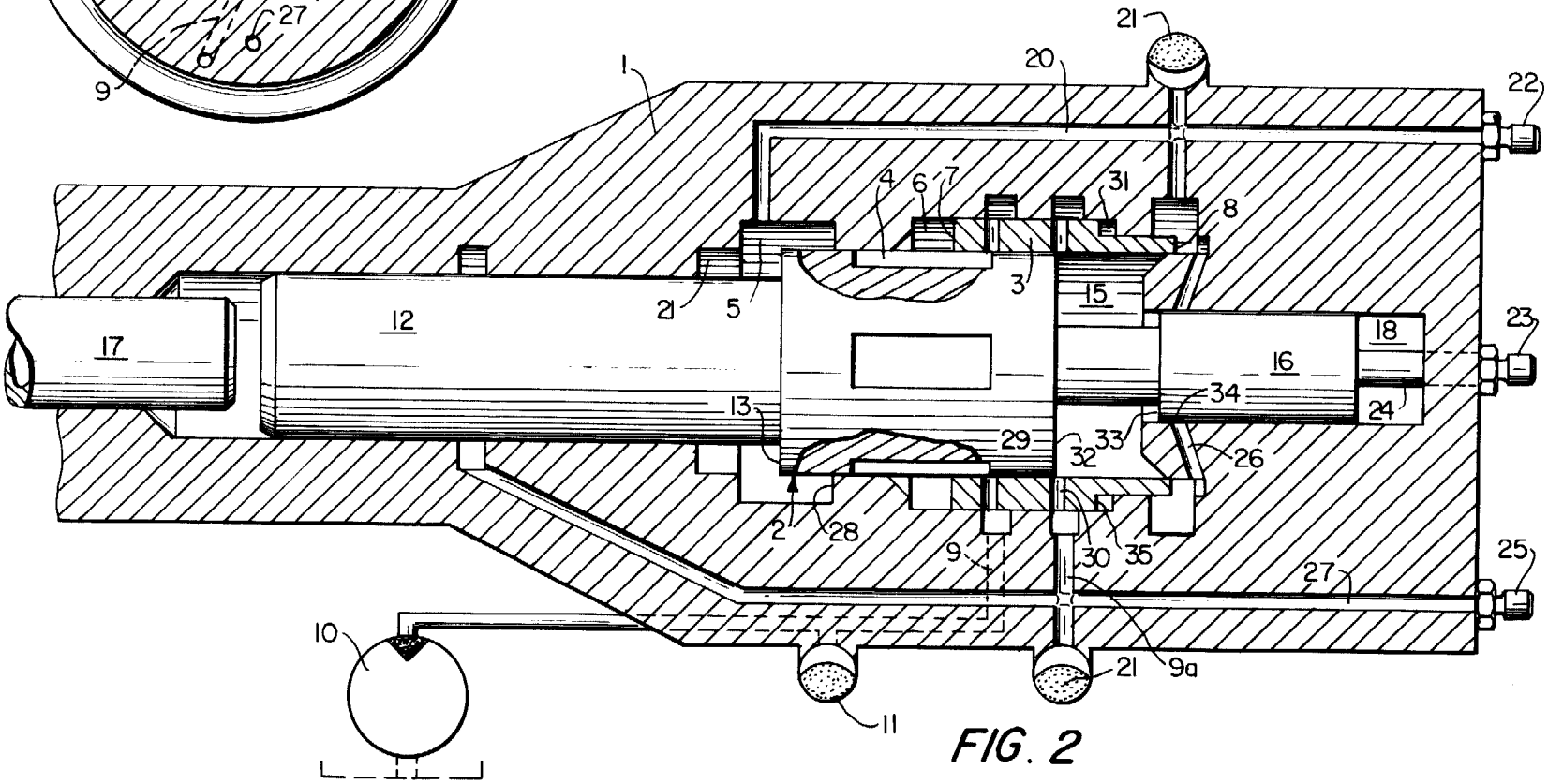
FIG. 2 is a side elevational view of the striking apparatus of the present invention partly in section, showing the piston at the beginning of a work stroke and the communication between the distributing valve space and the outlet canal.

Referring now to FIG. 1, the piston 2, the parts of which are a rod 12, a flange 13 and an extension 14, is shown near its second, lower position in the cylinder space of the body 1 where it slidably moves to and fro. A cylinder space is present below the flange 13, which space is called the lower space 5 and the cylinder space above the flange 13 is called the upper space 15. At the upper end of the extension, there is flange 16. While moving to and fro, the piston 2 strikes on the tool 17. If the tool 17 is not in place, the piston 2 stops in the absorber space 21 which is closed by the flange 13 when it is in its lowermost position whereby the pressure in the absorber space rises high enough to stop the motion of the piston. As seen in FIG. 2, the space 18 for the flange 16 of the extension 14 connects the upper space 15 with the inlet canal 20 through the canal 26 when the piston 2 is coming close to its upper turning point. A flushing tube 24 leads from nipple 23 through the striking apparatus for conveying a flushing liquid, such as water, into the bore of the tool or drill steel. For this purpose a water hose may be attached to nipple 23. The pressure pipe conveying the pressure liquid into the apparatus can be connected to the nipple 22, and correspondingly, the outlet pipe to the nipple 25. From the nipple 22 in the body of the apparatus begins the inlet canal 20 which leads to the lower space 5, the upper space 15 and the pressure accumulator 21. The flows of the liquid and the changes in pressure are balanced by the accumulator 21.

The inlet canal 20 is connected with the lower space 5 and through the distributing valve with the upper space 15. Differences in diameter of the piston 2 are such that the lower surface of the flange which is continuously under pressure is smaller than the upper surface, the pressure against which is either cut off or opened by the distributing valve 3 and the extension 14 of the piston. When the upper space 15 is under pressure, the piston 2 moves down. Correspondingly, when the upper space 15 is connected to the outlet canal 27, the piston moves up.

The liner type distributing valve 3 moves in the space 6 which is in the body 1 immediately around the part of the cylinder spaces 5 and 15 in which the flange 13 of the piston moves. Between the lower space 5 and the distributing valve space 6, there is an inwardly protruding annular member 28, the cylindrical inner surface of which forms part of the cylindrical wall of the cylinder spaces 5 and 15 around the flanges of the piston.

The part of the space 6 which is below the distributing valve 3 is connected with the lower space 5 by the canals 4 in the piston when the piston 2 has moved down enough. In the distributing valve 3, there are also openings 29 and 30 which are opposite to the outlet canals 9 and **9*a* from time to time. When the distributing valve 3 is high enough, as in FIG. 1, the liquid can flow from the upper space 15 through the opening 30 in the distributing valve 3 into the outlet canal 9*a*. The sizes of the upper and lower ends 8 and 7 of the distributing valve 3 are such that when the distributing valve space 6 in the lower end of the distributing valve 3 is connected through the canals 4 with the lower space 5 under pressure, the force caused by the pressure against the lower surface 7 of the distributing valve 3 moves the valve up. The reason for this is that the upper surface 8 of the distributing valve is smaller then the lower surface 7** and the pressure against both surfaces is the same.

FIG. 1 presents a situation where the piston 2 has just struck and is now starting its return movement. The distributing valve 3 is in its uppermost position stopped by the absorber 31. The pressure from the inlet canal 20 into he upper space 15 is completely closed and the escape through the hole 30 into the outlet canal **9*a* is open. The pressure in the lower space 5 forces the piston 2 to move up. The distributing valve space 6 is connected with the lower space 5 by the canals 4 in the piston 2**.

Figure 3:
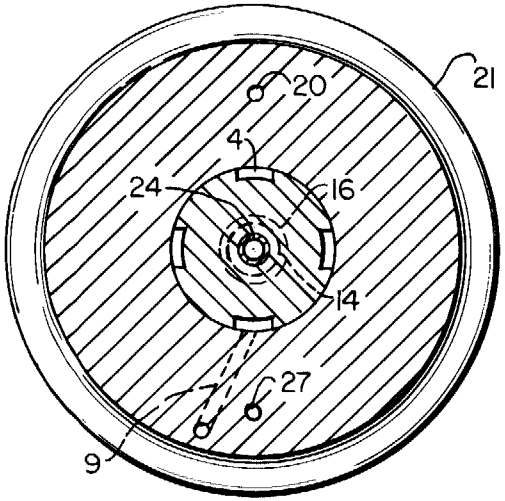
FIG. 3 is a sectional view of the apparatus taken along line 3—3 of FIG. 1 and looking in the direction of the arrows.

After the piston has struck tool 2, its return movement begins. The return movement of the piston is at first accelerated while the liquid of the upper space 15 escapes through the canal **9*a* into the outlet canal 27. The acceleration decreases and finally the movement of the piston starts to slow down while the upper end 32 of the flange of the piston starts to choke the flow into the outlet canal 9*a*, whereby the pressure in the upper space 15 starts to rise. In order to prevent it from rising far over the average pressure in the pressure network of the striking apparatus, the flange 16 of the extension 14 of the piston opens the connection 26 from the upper space 15 into the inlet canal 20 a little before the flange of the piston has completely closed the connection into the canal 9*a*. The liquid displaced by the piston while it is moving flows through the canal 26 into the inlet canal 20 and is stored in the accumulator 21. The said connection into the inlet canal is opened when the lower end 33 of the flange 16 of the extension 14 of the piston 2 has passed the lower edge 34 of the canal 26 and the said connection to the canal 9*a* is closed when the upper end 32 of the flange 13 of the piston 2 reaches the upper edge 35 of the opening 30. When the canal 9*a* is closed, the outlet phase into the outlet canal 27 has come to the end and the speed of the movement of the piston decreases. When the piston 2 has moved almost to its upper turning point while the distributing valve 3 is in its upper position, the canals 4, which areshown in cross-section in FIG. 3, in the flange 13 connect the distributing valve space 6 through the openings 29 in the distributing valve 3 with the outlet canal 9. Before this the flange 13 has closed the connection between the lower space 5 and the distributing valve space 6 with the aid of the neck 28 in the body 1, which neck is located between the lower space 5 and the distributing valve space 6. When the distributing valve space 6 is connected with the outlet canal 9, the pressure in the distributing valve space 6 decreases and the inlet pressure towards the upper surface 8 of the distributing valve 3 makes the distributing valve 3** move down.

When the flange 13 of the piston 2 closes the abovementioned connection and the canal 4 connects the space 6 through opening 29 with the outlet canal 9, the liquid from the space 6 flows into canal 9 which communicates fluid under pressure to hydraulic rotating motor 10 of the rock drill, which motor can be positioned either in the front or back end of the machine. In the accompanying drawings this motor is only shown schematically. Because the liquid under pressure is conducted from space 6 to the motor in interrupted fashion, it is desirable to provide a pressure accumulator schematically shown at 11 connected to the canal 9 between opening 29 and motor 10. The flow of pressured liquid from space 6 into canal 9 through which it is conducted to motor 10, causes rotation of that motor and rotation of the tool, the pressure fluctuation being somewhat smoothed by accumulator 11. The dotted spaces in accumulators 11 and 21 are pressurized gas, below which is a membrance and below the membrane is the hydraulic liquid, i.e., oil. The purpose of the pressure accumulator is to equalize the pressure variations in the oil system and to make the operation of the drill smoother.

When the piston 2 is moving upwards, the oil must always have free outlet of the upper space 15. Thus, when using the conventional piston construction, the distributing valve 3 should always start to move downwards a little before the opening 30 is closed while the valve is in its upper position. It is very difficult to synchronize these operations when the conventional piston construction is used. When using the extension 14 of the piston in the above manner, this difficulty is eliminated. Now the valve 3 can stand still when the flow from the upper space 15 through the canals 26 and 20 into the pressure accumulator 21 begins a little before the flow from the upper space 15 into the canal **11*a*** ends.

In FIG. 2 the piston 2 is ready to start its down stroke. At first the upper space 15 is filled through the canal 26 and the space 19 of the extension of the piston and simultaneously through the circular canal opened by the distributing valve 3. When the piston 2 has moved down enough, the lower end 33 of the flange 16 of the extension 14 of the piston closes the connection from the upper space 15 through the canal 26 into the inlet canal 20. The distributing valve 3 is stopped in its lower position by the absorber. When the piston 2 is moving down, it opens the connection between the lower space 5 into the distributing valve space 6 through the canals 4 slightly, before the piston 2 strikes at the tool 17. The pressure in the distributing valve space 6 rises and moves the distributing valve 3 up. The connection from the inlet canal 20 into the upper space 15 is closed and the opening 30 comes opposite to the outlet canal 9*a*. The distributing valve 3 is stopped by the absorber 31 in the position shown in FIG. 1.

When the distributing valve 3 is in its upper position, the distance between the upper end 32 of the flange 13 of the piston 2 and the lower end 33 of the flange 16 of the extension 14 of the piston is longer than the distances between the upper edge 35 of the outlet opening 30, which is in the distributing valve 3 outlet from the upper cylinder space 15, and the lower edge of the canal 26 leading from the space 15 of the extension 14 of the piston 2 into the inlet canal 20 of the pressure liquid, whereby the connection from the upper cylinder space 15 through the space 19 of the extension 14 of the said canal 26 into the inlet canal 20 of the pressure liquid opens before the flange 13 of the piston closes the opening 30 in the distributing valve 3, which leads into he outlet canal 9*a*.

The striking apparatus thus described offers many advantages in that it is simple in design, which results in the least possible amount of movement and wear of parts. In addition to certain advantages described in aforementioned application Ser. No. 569,531, the present invention provides the following:

1. Total consumption of liquid decreases because the pressure liquid can be better utilized in the machine.

2. The pressure canal from the space 6 to the rotating motor can be drilled into the body of the machine and thus no tube is needed for conveying liquid from an outside pump to the rotating motor.

3. Overloading of the machine due to too strong resistance to rotate is eliminated.

The invention is not limited to the rock drill arrangement which has been described as an example in this application, but it can be used in all hydraulic drill arrangements which comprise a striking piston, a pressure liquid-operated distributing valve guiding the piston and a hydraulic rotating motor.

While one advantageous embodiment has been chosen to illustrate the invention, it will be understood by those skilled in the art that various changes and modifications can be made therein without departing from the scope of the invention as defined in the appended claims.

What is claimed is:

1. An hydraulically operated striking apparatus comprising the combination of a body having an interior space;

a striking piston movable between first and second positions within said space;

a source of liquid under pressure;

means for defining a valve space;

a pressure liquid-operated distributing valve movable in said valve space for controlling application of said liquid under pressure to said interior space to control movement of said piston;

first outlet means for exhausting liquid from said interior space after said liquid has operated said piston;

second outlet means for exhausting liquid from said valve space after said liquid has operated said distributing valve;

an hydraulic rotating motor; and means for conveying liquid from said second outlet means to said motor to rotate said motor.

2. An apparatus according to claim 1 and further comprising a pressure accumulator communicating with said second outlet means.

* * * * *